US005540146A

United States Patent [19]

Lapp

[11] Patent Number: 5,540,146

[45] Date of Patent: Jul. 30, 1996

[54] WEB-FED PRINTING MACHINE HAVING A REGISTER DEVICE FOR ALIGNING THE PAPER WEB

[75] Inventor: Jaochim A. Lapp, Margetshöchheim, Germany

[73] Assignee: De la Rue Giori S.A., Lausanne, Switzerland

[21] Appl. No.: 434,275

[22] Filed: May 3, 1995

[30] Foreign Application Priority Data

May 20, 1994 [CH] Switzerland ..... 1579/94

[51] Int. Cl.[6] ..... B41F 9/02; B41F 13/02

[52] U.S. Cl. ..... 101/152; 101/228

[58] Field of Search ..... 101/228, 174, 101/175, 176, 178, 151, 152, 153, 154

[56] References Cited

FOREIGN PATENT DOCUMENTS 0018223 10/1980 European Pat. Off. .
0415881 3/1991 European Pat. Off. .
0562159 9/1993 European Pat. Off. .
3913700 11/1990 Germany .
8304988 11/1991 Germany .

*Primary Examiner*—J. Reed Fisher
*Attorney, Agent, or Firm*—Kane, Dalsimer, Sullivan, Kurucz, Levy, Eisele and Richard, LLP

[57] ABSTRACT

The web-fed printing machine has two cylinders (2, 3) which form the nip, a paper-web-directing device (10) with an infeed roller (14) and a discharge roller (15), which are arranged adjustably on both sides of the nip (S), and an upstream web-feeding device (20), which likewise exhibits an infeed roller (22) and a discharge roller (23). In order to align the paper web, the web-directing device (10) can be displaced in a plane running through the axes of the rollers, and can be adjusted as a function of the signals from web-edge sensors (16, 17) such that it can be adjusted in the direction of the axes of rotation of the rollers and can be pivoted into an oblique position. The web-feeding device (20) can be pivoted about a stationary spindle (24) and is connected mechanically to the web-directing device.

10 Claims, 9 Drawing Sheets

27
17
15
19
13
11
10
D
S
2
1
3
25
23
12
B
18
16
14
26
B
22
21
20
1
24

B
15
19
11
D
3
14
23
25
18
21
22
24
B

Fig. 8
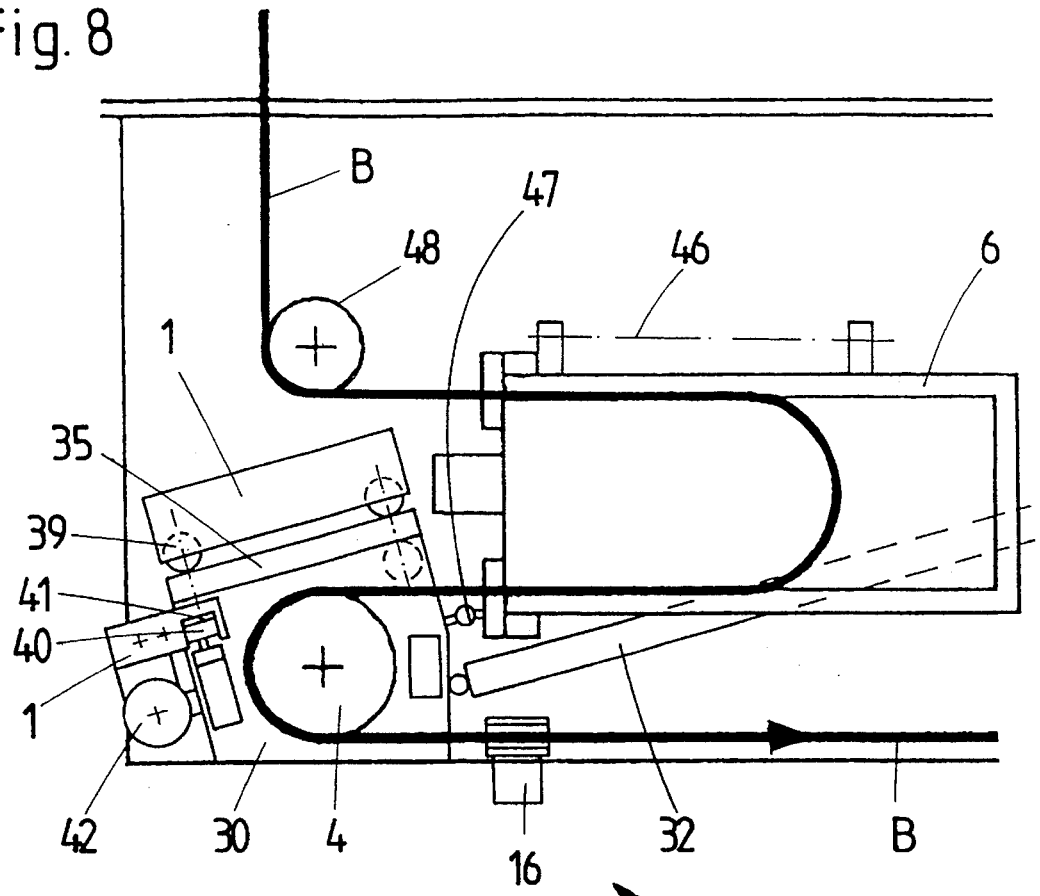
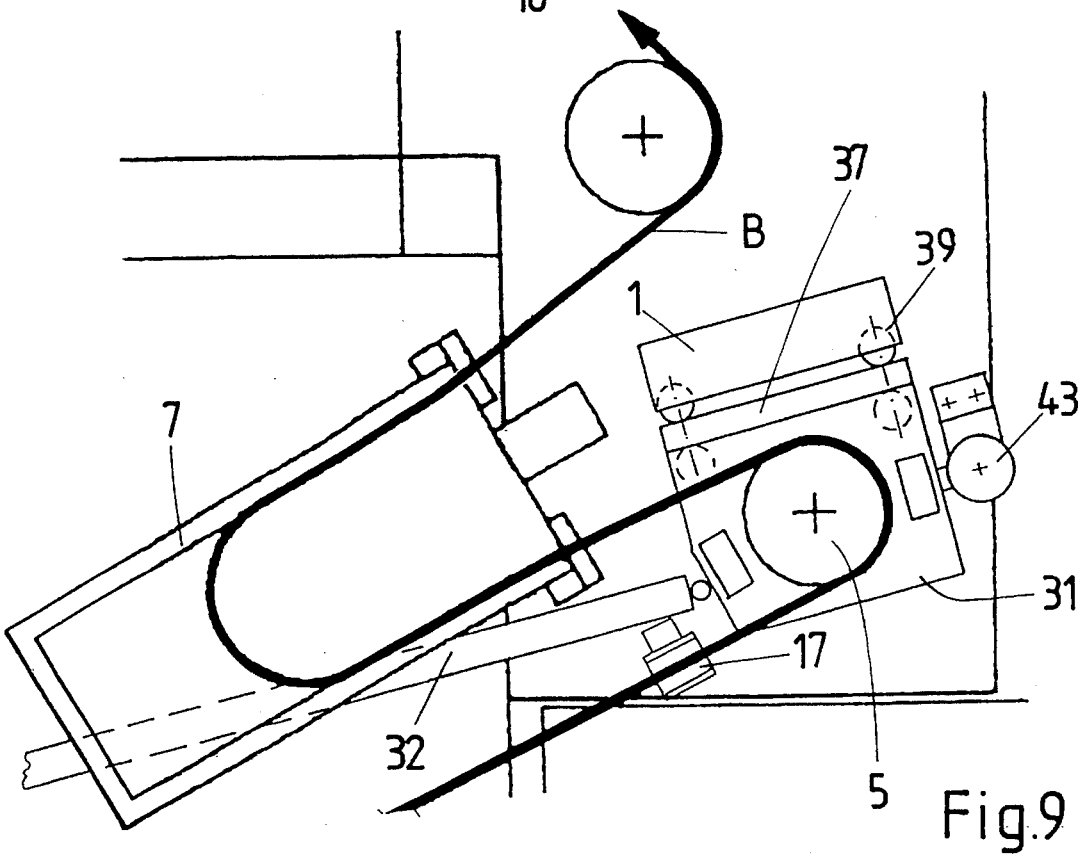
Fig.9

WEB-FED PRINTING MACHINE HAVING A REGISTER DEVICE FOR ALIGNING THE PAPER WEB

FIELD OF THE INVENTION

The invention relates to a web-fed printing machine having two cylinders which form the nip And between which the paper web runs, at least one side thereof being printed in the process, and having a register device for aligning the web, said device exhibiting infeed and discharge rollers which guide the web and of which the position can be controlled by means of an actuating device by way of measuring signals from web-edge sensors.

PRIOR ART

EP-A-0 415 881 describes a web-fed printing machine having a plurality of printing units in which the paper web is driven and guided by means of drawing rollers which are installed on both sides of the nip of each printing unit. Installed upstream of the drawing rollers which are located upstream of the nip of each printing unit are in each case a paper-web store and a register device, which is arranged upstream of said store and is intended for the lateral alignment of the paper web, and in each case one paper-web store is provided downstream of the drawing rollers located downstream of each nip.

It is known that the devices for the lateral alignment of the paper web exhibit a rotary frame on which the paper web is guided by way of infeed and discharge rollers, mounted at the frame ends, and of which the position can be controlled, for the purpose of correcting the position of the paper web, by way of measuring signals from web-edge sensors. The arrangement of these devices in the known web-fed printing machine in accordance with EP-A-0 415 881 requires a considerable amount of space in the transporting system of the paper web before said paper web runs through the first paper-web store. Moreover, any deviations from the correct paper-web path which occur upon passing the paper-web store and the drawing roller can no longer be compensated for.

In the case of the web-fed printing machine described in the abovementioned publication, the printing units are designed in the manner of sheet printing units in the case of which the cylinders forming the nip have printing zones separated by cylinder gaps. In order to avoid the situation where, upon running through the cylinder gaps, unprinted white strips appear on the paper web, as would occur in the case of continuous paper-web transportation, the known web-fed printing machine is equipped for so-called pilgrim step operation. That is to say the paper web is transported at a continuous speed only upstream and downstream of each printing unit and during a printing operation, during abutment against the printing zones of the two cylinders, but, in contrast, is braked, drawn back and accelerated again by the drawing rollers when it passes a cylinder gap, that is to say in the free, non-clamped state, with the result that, when passing the following printing zone, the paper web runs synchronously with the cylinders again. Consequently, it is possible not only for the printed images to be printed onto the paper web at a predetermined narrow spacing, for the purpose of saving paper, but also for printed images of variable length to be produced, for individual register corrections to be carried out for each individual print, and for the repeat length of the individual prints on the paper web to be varied irrespective of the length of the printed images. In this arrangement, the paper-web stores between the continuously moved paper-web sections upstream and downstream of the printing unit and the paper-web section which is moved in pilgrim step and is located in the printing unit serve as buffers. Due to the very high dynamics with which the paper web has to be drawn back and accelerated again, said paper-web stores are designed as vacuum-type stores which do not exhibit any metal directing rollers which are to be accelerated, but do not guarantee lateral guidance of the web. Thus, in the case of certain paper qualities, if the paper is not uniform over the web width, a lateral oscillating movement of the web may occur, this being impermissible for the required side register, in particular in the case of banknote prints. Moreover, the paper web may tend, as a result of a lack of uniformity, to run obliquely through the printing unit, which would result in correspondingly oblique prints on the web.

Correct alignment of the paper web is thus particularly important in the case of a pilgrim-step-operation web-fed printing machine with sheet printing units and cannot be reliably carried out using the hitherto known register devices for alignment purposes, as is to be explained briefly with reference to FIG. 1 which illustrates the prior art.

FIG. 1 shows, schematically, a web-fed printing machine in which the paper web B runs through an intaglio printing unit which is designed in the manner of a sheet printing unit with a plate cylinder 2 and with an impression cylinder 3. These two cylinders 2 and 3, mounted in the machine framework 1, form the nip S, through which the paper web B runs, and exhibit printing saddles 2*a* and 3*a*, respectively, which are separated by cylinder gaps 2*b* and 3*b*, respectively, form the printing zones and, in the case of the plate cylinder 2, bear intaglio printing plates and, in the case of the impression cylinder, bear the printing coverings. In the case in hand, these cylinders each have three printing zones. As is customary, the clamping elements for the printing plates and the printing coverings are accommodated in the cylinder gaps 2*b* and 3*b*, respectively.

Installed upstream and downstream of the nip S are drawing rollers 4 and 5, respectively, which should be located as near as possible to the nip and are controlled such that the web section is transported between said drawing rollers in the abovementioned pilgrim step operation. During one printing phase, said drawing rollers 4, 5 and the cylinders 2, 3 rotate at the same circumferential speed. The drawing rollers 4 and 5 are known suction rollers which secure that section of the paper web looping around them by a vacuum, with the result that no press-on rollers are required. In each case one paper-web store 6 and 7 in the form of a known vacuum-type store is installed upstream of the drawing roller 4 and downstream of the drawing roller 5, respectively.

Provided upstream of the nip S is a measuring roller 59 which is intended for measuring the tensile stressing of the web and around which the paper loops to a partial extent.

In the example in hand, the plate cylinder 2 is colored with different inks by three stencil rollers 50 which, for their part, are colored by inking units 51 which are installed on a removable inking unit framework 52. The directions of rotation of the cylinders and the transporting direction of the paper web B are indicated by arrows. A damping device 53 acting on the plate cylinder is installed downstream of the stencil rollers.

Serving to align the paper web B is a register device 54 which is arranged upstream of the paper-web store 6, as seen in the transporting direction, and has a rotary frame 55 which exhibits two spaced-apart directing rollers 56 and 57 for the paper web B and of which the position is controlled by web-edge sensors (not shown). This device 54 requires a sufficiently long infeed stretch E, which has to lie at right angles with respect to the rotary frame 55, and a sufficiently long discharge stretch A; moreover, at least one further directing roller 58 is necessary at the end of the discharge stretch A, which directing roller changes the direction of the paper web through at least 90°.

In order then to ensure correct alignment of the paper web as it runs through the nip, the device 54 or a similar device would have to be installed between the first drawing roller 4 and the nip S, this, however, not being possible in practice. On the one hand, the web section between the drawing roller 4 and the nip S would be impermissibly long and, on the other hand, the directing rollers, during the very dynamic acceleration operations in pilgrim step, could not be accelerated in a slip-free manner by the paper web, which would result in the lateral guidance of the web being lost.

SUMMARY OF THE INVENTION

The object of the present invention is to configure, and arrange, a register device for aligning the paper web in web-fed printing machines in a space-saving manner, such that precise alignment of the paper web is ensured as it runs through the nip, it also being possible for any oblique positioning of the web to be corrected without an impermissibly long web section having to be provided for this register device upstream of the nip. The printing machines may be conventional web-fed printing machines with constant paper-web transportation which do not require a paper-web store; in particular, however, the register device according to the invention is intended to be usable for pilgrim-step-operation web-fed printing machines and to avoid the abovementioned specific difficulties arising in the case of said printing machines.

This object is achieved by the features specified in the defining part of claim 1.

In this manner, the space available directly on both sides of the nip is utilized to accommodate the directing device, which permits direct correction of the position of the paper web in the nip.

In accordance with one example, the directing device may be designed as a rotary frame, of which the infeed roller and discharge roller are located on both sides of the nip. When used on a pilgrim-step-operation web-fed printing machine, the arrangement is preferably such that the two drawing rollers on both sides of the nip function as adjustable infeed and discharge rollers.

Further features of the invention are given in the dependent claims.

BRIEF DESCRIPTION OF THE DRAWINGS

The invention is explained in more detail, by way of a number of exemplary embodiments, with reference to the drawings, in which:

FIG. 8 shows an enlarged representation of the paper-web transportation upstream of the nip of the printing unit according to FIG. 7, with paper-web store and drawing roller, FIG. 9 shows an enlarged representation of the paper-web transportation downstream of the nip, with drawing roller and paper-web store.

DESCRIPTION OF THE PREFERRED EMBODIMENT(S)

Figure 2:
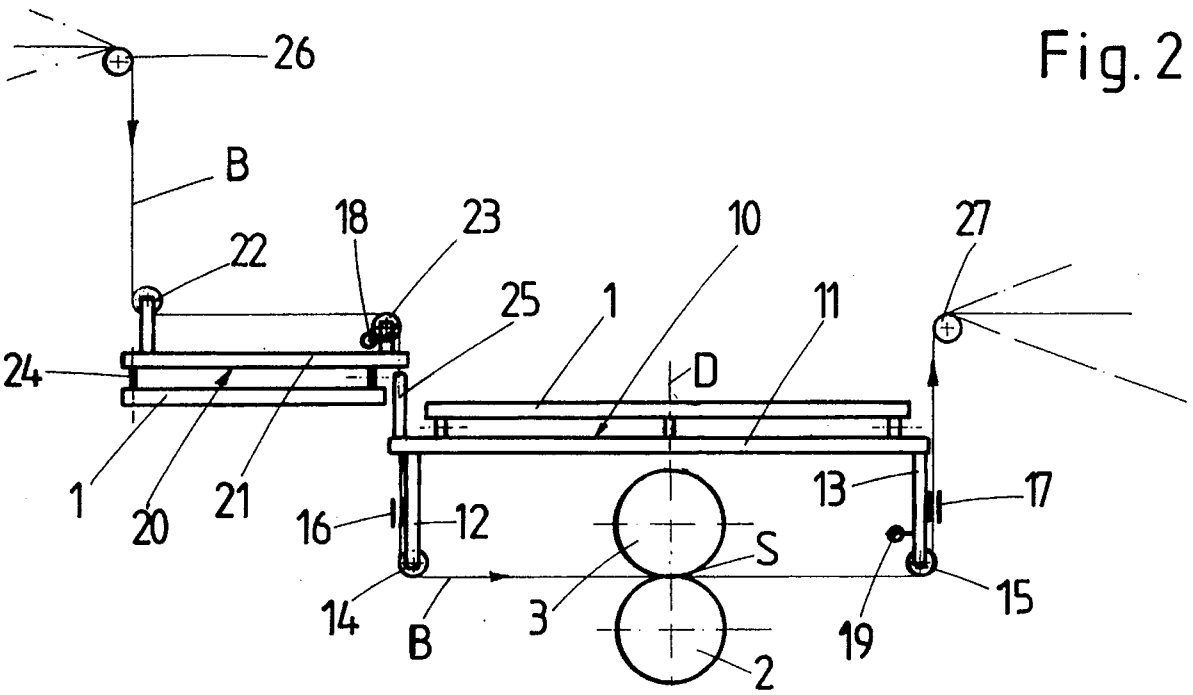
FIG. 2 shows a schematic side view of a first embodiment of the invention having two mechanically coupled rotary frames.
Figure 3:
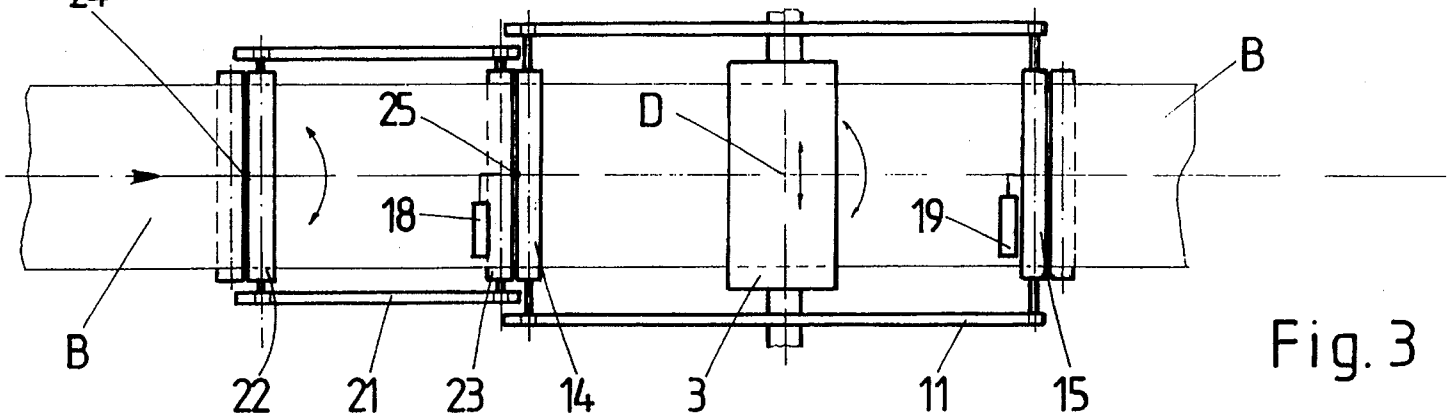
FIG. 3 shows a plan view of the representation according to FIG. 2, FIGS. 4, 5 and 6 show plan views, corresponding to the representation according to FIG. 3, of three different settings of the two rotary frames.

The first embodiment of the invention represented in FIGS. 2 and 3 relates to a conventional web-fed printing machine with constant paper-web transportation and with the two printing-unit cylinders 2 and 3 which form the nip S, and with a register device, which comprises a directing device for the paper web B in the form of a rotary frame 10 as well as a feeding device which is provided upstream of said rotary frame and is likewise in the form of a rotary frame 20. The rotary frame 10 exhibits a rectangular framework 11 which, in the example according to FIG. 2, is mounted movably on the machine framework 1, above the printing-unit cylinders 2 and 3, and has, on the infeed side, an infeed roller 14 located upstream of the nip S and, on the discharge side, a discharge roller 15 located downstream of the nip S. Said rollers 14 and 15 are mounted at the ends of carrying rods 12 and 13 which are fastened on the underside of the framework 11 and reach to the level of the nip S, which is located centrally between the rollers 14 and 15. The width of the rotary frame 10 is greater than the length of the cylinders 2, 3.

The rotary frame 20 likewise has a rectangular framework 21 with an infeed roller 22 and a discharge roller 23 and is mounted rotatably about a spindle 24 which is mounted in a stationary manner in the machine framework 1, is arranged centrally with respect to the infeed roller 22 and is located in a plane which is oriented perpendicularly with respect to the axis of said infeed roller 22, and thus also perpendicularly with respect to the axis of the infeed roller 14. The plane of the rotary frame 20 is offset in parallel relative to the plane of the rotary frame 10. The discharge side of the rotary frame 20 and the infeed side of the rotary frame 10 are located at least approximately vertically one above the other and are connected to one another by a free spindle 25 which is arranged centrally with respect to the rollers 14 and 23.

Said spindle forms a common pivot spindle 25, which can be displaced relative to the machine framework 1, for the two rotary frames and is located perpendicularly with respect to the plane running through the axis of the rollers 14 and 15.

The paper web B runs, in the direction of the arrows, over a guide roller 26 to the infeed roller 22 of the rotary frame 20 and then over the discharge roller 23 of said rotary frame, which discharge roller 23 deflects the paper web through 90° in the direction of the infeed roller 14 of the rotary frame 10, where the paper web is once again deflected through 90°. The paper web B passes the nip S between the infeed roller 14 and the discharge roller 15 of the rotary frame 10 and is subsequently transported further over a further guide roller 27.

Provided upstream and downstream of the nip S, as indicated schematically in FIG. 2, are web-edge sensors 16 and 17 which, in the example in hand, are arranged just upstream of the infeed roller 14 and just downstream of the discharge roller 15, respectively, along the web sections running perpendicularly with respect to the plane of the rotary frame 10, and monitor the lateral alignment or any oblique positioning of the web. Said web-edge sensors are known, contactlessly operating sensors, in particular optical or pneumatic sensors. The measuring signals of said web-edge sensors 16 and 17 control two actuating members 18 and 19. The first actuating member 18 can adjust the pivot spindle 25, that is to say the rollers 14 and 23 connected thereto, transversely with respect to the running direction of the paper web B, and the second actuating member 19, independently of the actuating member 18, can adjust the discharge side 15 of the rotary frame 10 with the discharge roller 15 in one direction or the other, likewise transversely with respect to the web-running direction. The actuating members 18 and 19 are connected in an articulated manner to the frame parts bearing the relevant rollers, such that said rollers can be adjusted in the direction of their axes, if appropriate with simultaneous pivoting, that is to say they can be displaced in a plane running through the roller axes. Said individual adjustment of the abovementioned rollers as a function of the measuring signals of the web-edge sensors 16 and 17 can result in side corrections alone, by parallel displacement of the paper web, as well as corrections to oblique positioning of the paper web, as is illustrated hereinbelow with reference to FIGS. 4 to 6.

Figure 4:
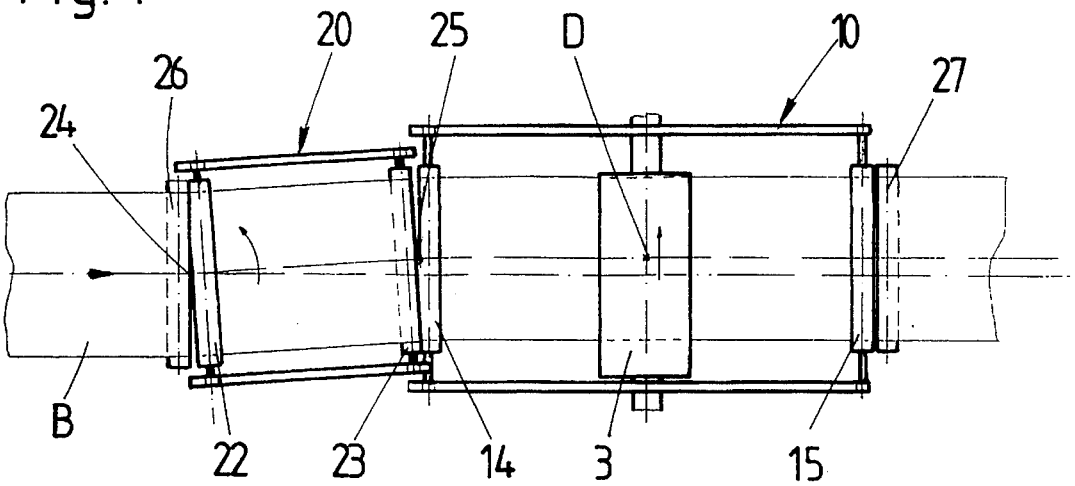

In the example according to FIG. 4, lateral correction of the paper web B takes place, in that the two actuating members 18 and 19 are displaced in the same direction by the same amount such that the paper web once again runs centrally between the two web-edge sensors 16 and 17. By virtue of this adjustment, the rotary frame 10, and thus the web section which runs through the nip and is located between the infeed roller 14 and the discharge roller 15, is displaced in the direction of the straight arrow, perpendicularly with respect to the web-running direction, while the rotary frame 20 is pivoted about the stationary spindle 24 in the direction of the bent arrow, and correspondingly about the common free pivot spindle 25.

Figure 5:
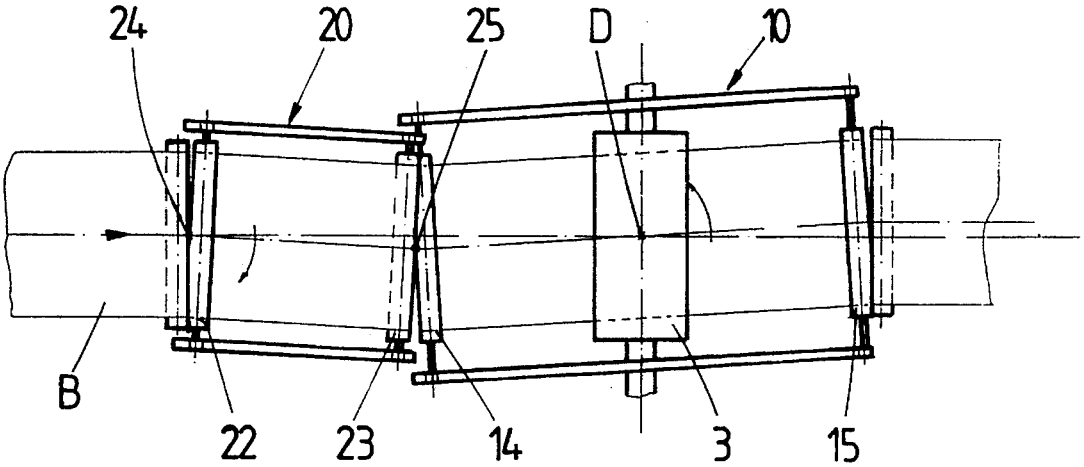

In the example according to FIG. 5, the web-edge sensors 16 and 17 have indicated different deviations of the web from its central course, with the result that oblique correction is necessary. For this purpose, the two actuating members 18 and 19 adjust the rollers assigned to them by the same amount in opposite directions. Since the nip S is located centrally between the infeed and discharge rollers 14 and 15 of the rotary frame 10, this results in the rotary frame 10 effecting a certain rotation in the direction of the bent arrow about the imaginary axis of rotation D, which runs centrally through the nip S and lies on the connecting line between the axes of the two cylinders 2 and 3, while the rotary frame 20 is rotated about the stationary spindle 24 in the opposite direction. In this arrangement therefore, all that takes place is an angular correction of the paper web about the imaginary axis of rotation D, without any lateral displacement. In the example according to FIG. 4, said imaginary axis of rotation D was merely displaced laterally.

Figure 6:
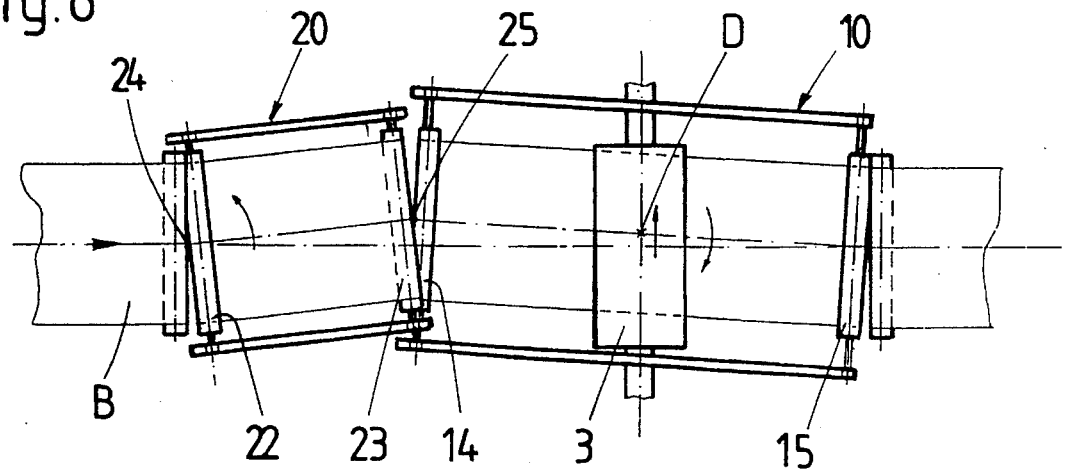

In the example according to FIG. 6, a combined correction takes place, namely lateral displacement and simultaneous rotation of the paper web. In this case, the discharge roller 23 of the rotary frame 20 and the infeed roller 14 of the rotary frame 10 are adjusted, by way of corresponding adjustment of the common spindle 25, by means of the actuating member 18 in one direction by a greater amount than is the discharge roller 15 of the rotary frame 10 in the other direction with the aid of the other actuating member 19. The two rotary frames are thus rotated, as indicated by the bent arrows, in different directions, and the rotary frame 10 is simultaneously displaced in the direction of the straight arrow.

It should be noted that the paper web can be aligned correctly with respect to the printing-unit cylinders, before the start of the printing operation, with the aid of adjustably mounted web-edge sensors, in that the position of said web-edge sensors is adjusted mechanically or electrically.

Figure 1:
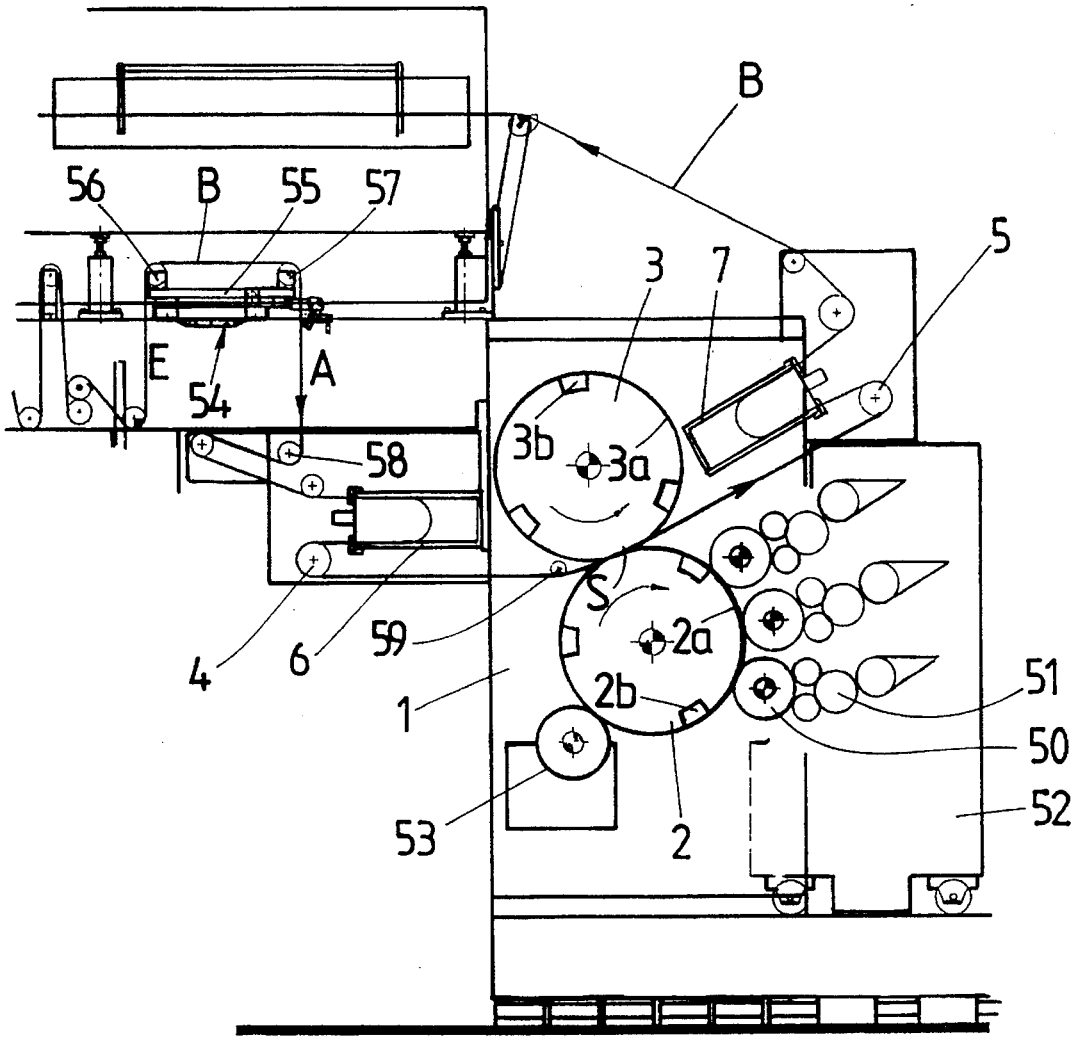
FIG. 1 shows, in order to illustrate the abovedescribed prior art, a known intaglio printing unit having a register device for aligning the paper web.
Figure 7:
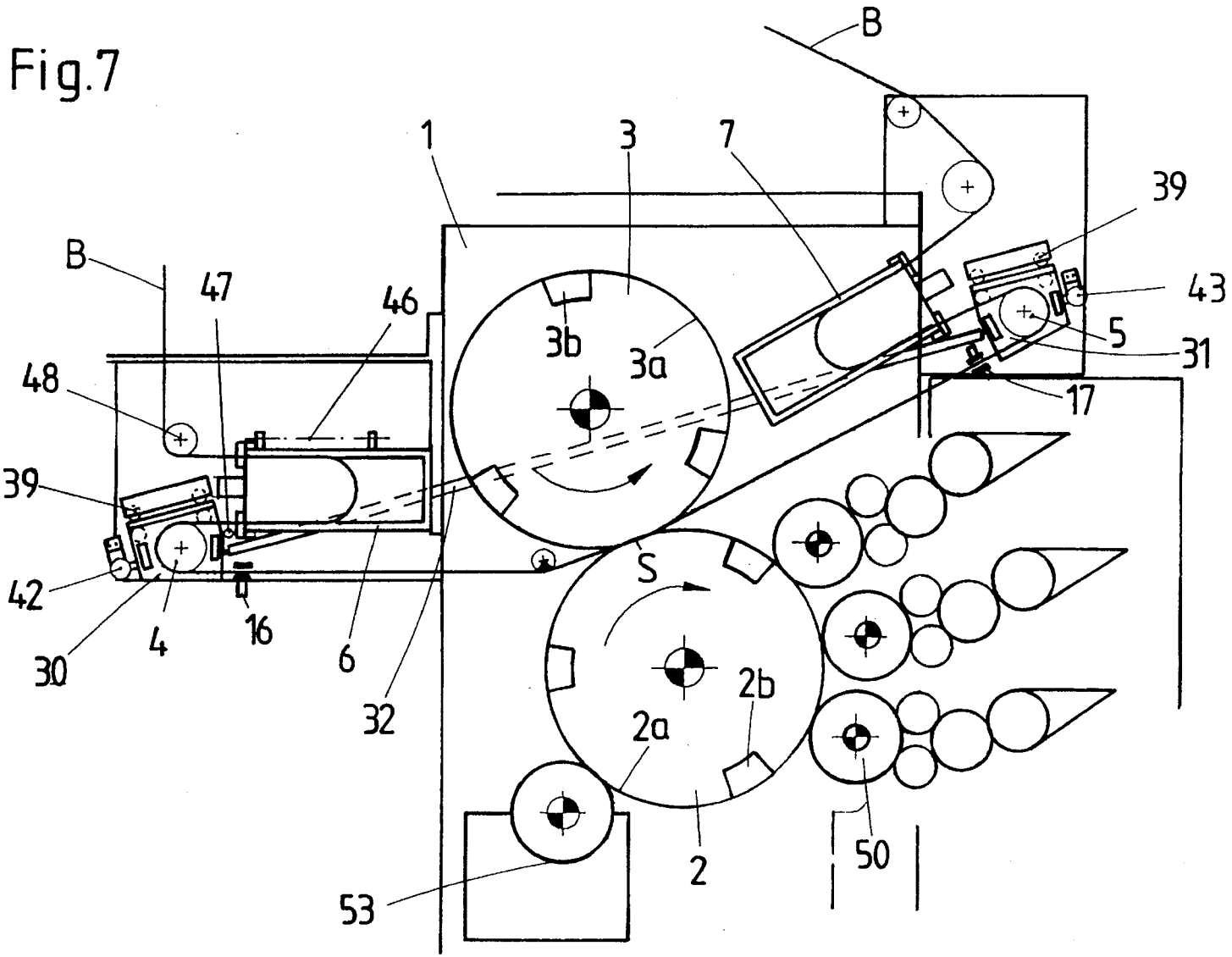
FIG. 7 shows a schematic side view of a second embodiment of the invention, the printing unit with the drawing rollers and paper-web stores corresponding to the printing unit represented in FIG. 1.

In the example according to FIGS. 7 to 11, the web-fed printing machine represented is an intaglio printing unit in the form of a sheet printing unit with pilgrim-step-operation paper-web transportation, as has already been described with reference to FIG. 1. FIG. 7 shows the same printing machine as FIG. 1, with a plate cylinder 2 colored by stencil rollers 50 and with an impression cylinder 3, the two cylinders having three printing zones **2*a* and 3*a*, respectively, separated by cylinder gaps 2*b* and 3*b*, respectively. A drawing roller and an upstream paper-web store 6 are installed up-stream of the nip, and a drawing roller 5 and a down-stream paper-web store 7 are installed downstream of the nip. The drawing rollers are controlled suction rollers on which the paper web is retained by a vacuum. The difference from the printing machine according to FIG. 1 consists in the arrangement and design of the register device, the function of which is taken over by the drawing rollers 4, 5 and the paper-web store 6. A register device 54 arranged upstream of the paper-web store 6, as seen in web-running direction, such as that represented in FIG. 1** is thus dispensed with.

The drawing roller 4 upstream of the nip S forms the infeed roller and the drawing roller 5 downstream of the nip S forms the discharge roller of a directing device which corresponds to the rotary frame 10 according to FIGS. 2 to 6. The two drawing rollers 4 and 5 are mounted in a common frame, which comprises a frame part 30 for the drawing roller 4, a frame part 31 for the drawing roller 5 and a connecting frame 32 which is fastened to the frame parts 30 and 31 by means of point fastenings. The width of the frame is greater than the length of the printing-unit cylinders 2 and 3 to such an extent that said cylinders are located within the frame, in the plan view according to FIG. 10.

The connecting frame 32, which is preferably a lightweight frame made of steel tubing or a carbon fiber composite material, absorbs the paper tensile forces and the shear forces between the drawing rollers.

The drawing rollers 4 and 5 have their drive motors 33 and 34, respectively, directly flange-mounted on them. The frame with the drawing rollers 4 and 5 is mounted movably in a plane running through the axes of the drawing rollers 4 and 5. For this purpose, the frame parts 30 and 31 are provided on both sides with angle pieces 35, 36 and 37, 38, respectively, of which the legs, oriented parallel with respect to the axis of the drawing rollers, are all located in one plane and are mounted movably on both sides in the machine framework 1 with the aid of ball-type guides 39.

Figure 11:
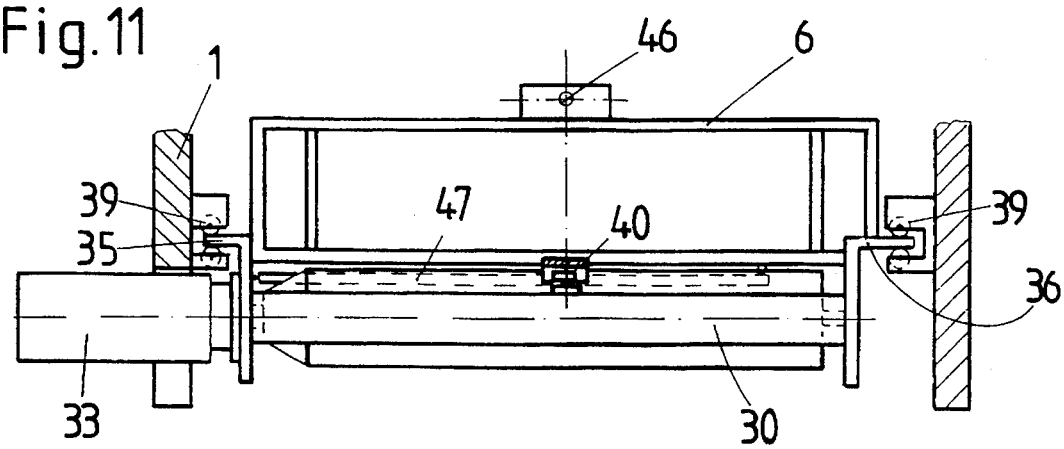
FIG. 11 shows a view of the drawing roller which is located upstream of the nip as well as of the associated paper-web store.
Figure 10:
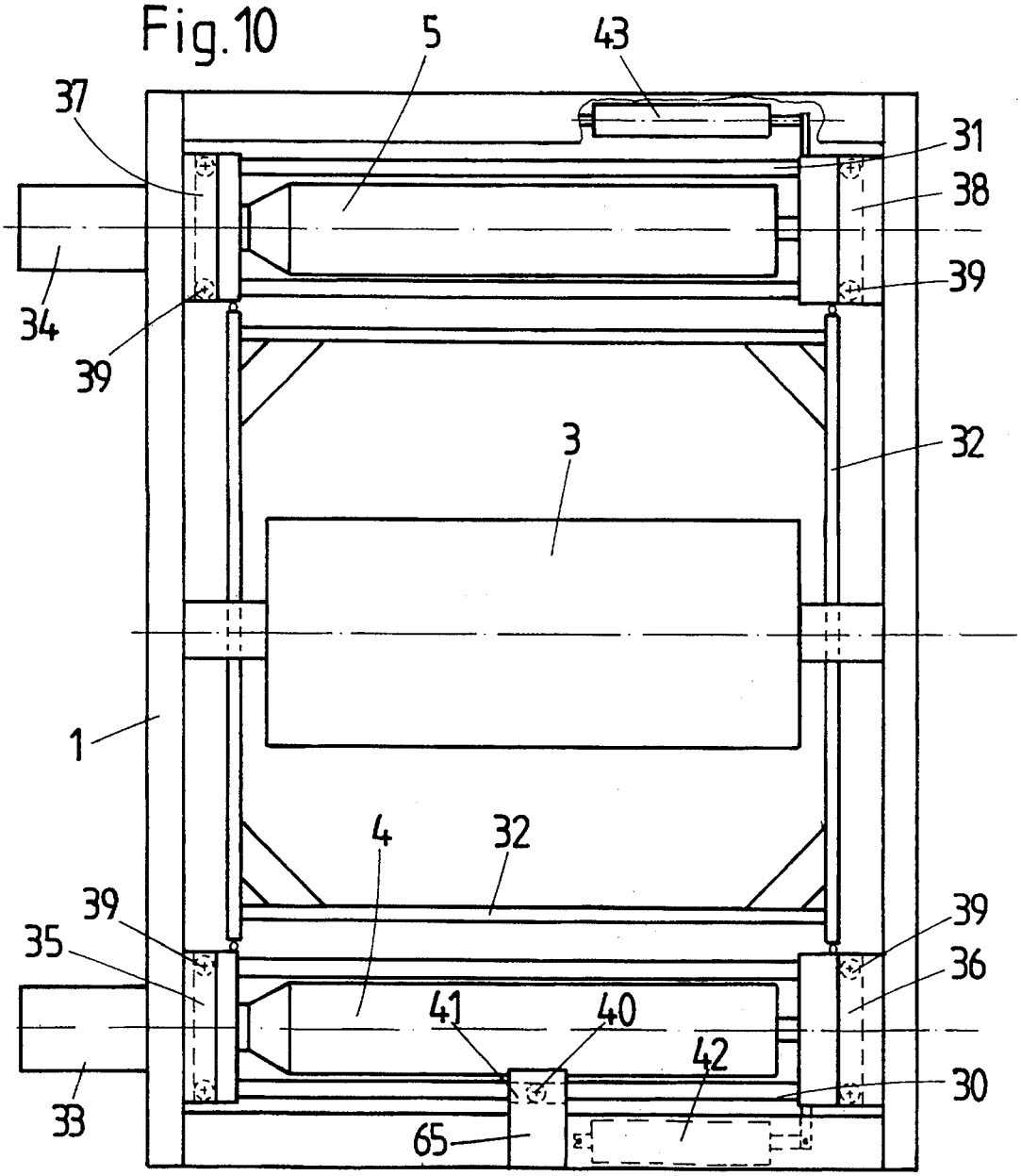
FIG. 10 shows a plan view of the printing unit according to FIG. 7 with the two drawing rollers installed on both sides of the printing-unit cylinders.

The directing-device spindle corresponding to the free pivot spindle 25 in the example according to FIGS. 2 to 6 is formed by a cam roller 40 which, according to FIGS. 10 and 11, is mounted in the center of the frame part 30 of the drawing roller 4, that is to say centrally with respect to said drawing roller, and of which the axis is oriented perpendicularly with respect to the plane running through the axes of the drawing rollers. Said cam roller 40 is guided in a groove 41 which runs parallel to the axis of the drawing roller 4 and is provided in a guide segment 65 fastened on the machine framework 1. The free pivot spindle, formed by the cam roller 40, of the frame 30, 31, 32 can be moved, by way of this guide, only parallel with respect to the drawing-roller axis.

Acting on each of the frame parts 30 and 31 is an individual, articulated actuating member 42 and respectively, which can adjust each frame end, that is to say each of the two drawing rollers 4 and 5, in the axial direction thereof, to be precise in dependence on the measuring signals of the web-edge sensors 16 and 17 which are installed upstream and downstream of the nip and, here, are located directly downstream of the first drawing roller 4 and upstream of the second drawing roller 5, respectively. The entire arrangement is such that the nip S is located in the center between the two adjustable drawing rollers 4 and 5, and the entire frame with the drawing rollers 4 and 5 effects an imaginary rotation about a point of rotation D, located in the nip S on the line connecting the axes of plate cylinder 2 and impression cylinder 3, if the two drawing rollers 4 and 5 are adjusted by different amounts by their actuating members 42 and 43, respectively, corresponding to the positions of the rotary frame 10 according to FIGS. 5 and 6. If the two drawing rollers 4 and 5 are adjusted by the same amounts in the same direction by their actuating members 42 and 43, then a purely parallel displacement of the frame, and thus of the paper-web section between the rollers 4 and 5, takes place, corresponding to the representation of the rotary frame 10 according to FIG. 4.

In the example according to FIGS. 7 to 11, the feeding device 20 which appears in FIGS. 2 to 6 is formed by the paper-web store 6, which is mounted, on its infeed side, on the machine framework 1 such that it can tilt about a stationary spindle 46 running along the infeeding section of the paper web B. Expressed in more general terms, said tilting spindle 46 lies in a plane which is oriented perpendicularly with respect to the axis of the infeed roller of the directing device, that is to say with respect to the axis of the drawing roller 4, and at least approximately intercepts said axis in the center.

The paper-web store 6 and the frame part 30, in which the drawing roller 4 is mounted, are connected to one another mechanically by an articulated track rod Said track rod 47 is articulated on the side located opposite the tilting spindle 46 of the paper-web store 6, the side on which the paper web is discharged; the other end of the track rod 47 is articulated on the left-hand side, according to FIG. 11, of the frame part 30 of the drawing roller 4. In the example according to FIGS. 2 to 6, the pivot spindle 25 carries out the function of the mechanical connection between feeding and directing devices.

The paper web B passes, over an infeed roller into the paper-web store 6, the latter being a vacuum-type store. The discharge roller of said paper-web store is identical to the drawing roller 4, that is to say the infeed roller of the directing device. The described arrangement results, in the event of an adjustment of the frame part 30 with the drawing roller 4, in the paper-web store 6 being carried along by the track rod 47, with corresponding rotation about the tilting spindle 46, such that the direction of the paper web feeding into the directing device over the drawing roller 4 is correspondingly changed, as is shown, in principle, by FIGS. 4 to 6 for the embodiment having two coupled rotary frames.

Since, in the example according to FIGS. 7 to 11, the drawing rollers 4 and 5 and the paper-web store 6 form the directing and feeding devices directly, any additional mass of devices which is to be accelerated, for example for additional paper-directing rollers, is avoided, and there is no additional lengthening of the paper-web section in the region of the nip S between the drawing rollers 4 and 5.

Figure 12:
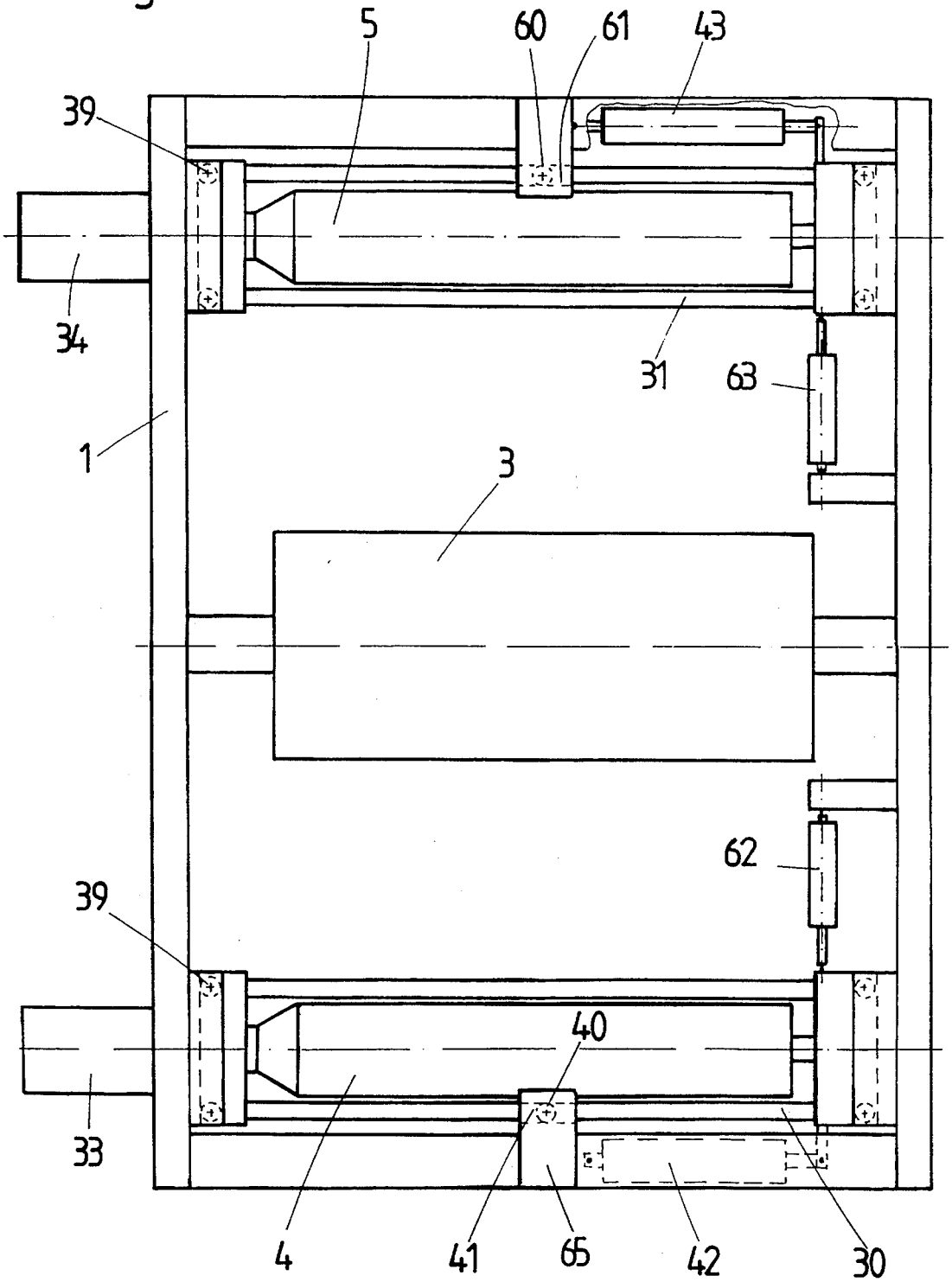
FIG. 12 shows a plan view, corresponding to the view according to FIG. 10, of a third embodiment of the invention.

The exemplary embodiment according to FIG. 12 shows a directing device in which the infeed and the discharge rollers are likewise formed by drawing rollers 4 and 5 which are mounted in frame parts 30 and 31, respectively, on both sides of the nip of a pilgrim-step-operation printing unit, of which frame parts the frame part 30 is designed and guided in precisely the same manner as in the example according to FIGS. 2 to 6. The two frame parts 30, 31 are again mounted in the framework 1, by means of ball-type guides 39, such that they can be displaced in the plane running through the drawing-roller axes. In the example according to FIG. 12, however, said frame parts 30 and 31 are independent of one another and are not connected to one another by a connecting frame. Instead, the frame part 31 bearing the drawing roller 5 is likewise provided, as is the frame 30, in the center with a cam roller 60 which is guided in the machine framework 1 in a groove 61 running parallel to the axis of the drawing roller and of which the axis is perpendicular with respect to the plane running through the roller axes.

In addition to the two actuating members 42 and 43, which effect adjustment of the drawing rollers in the direction of their axes, each frame part 30 and 31 is subjected to the action of a second actuating member 62 and 63, respectively, which can effect displacement perpendicularly with respect to the drawing-roller axis and thus ensures the precise angular position of the drawing rollers 4 and 5, respectively, to be precise once again as a function of the measuring signals of the web-edge sensors. By a suitable activation of the actuating members, the drawing rollers are then aligned together such that they precisely assume the position which they would assume if a mechanical connecting frame were used. The two drawing rollers 4 and 5 thus belong, as it were, to an "electronic rotary frame". In this arrangement, the actuating members either have to be provided with stepping motors or have to have suitable sensors for position detection. The embodiment without a connecting frame between the drawing rollers is advantageous whenever there is not sufficient space in the printing unit.

Figure 14:
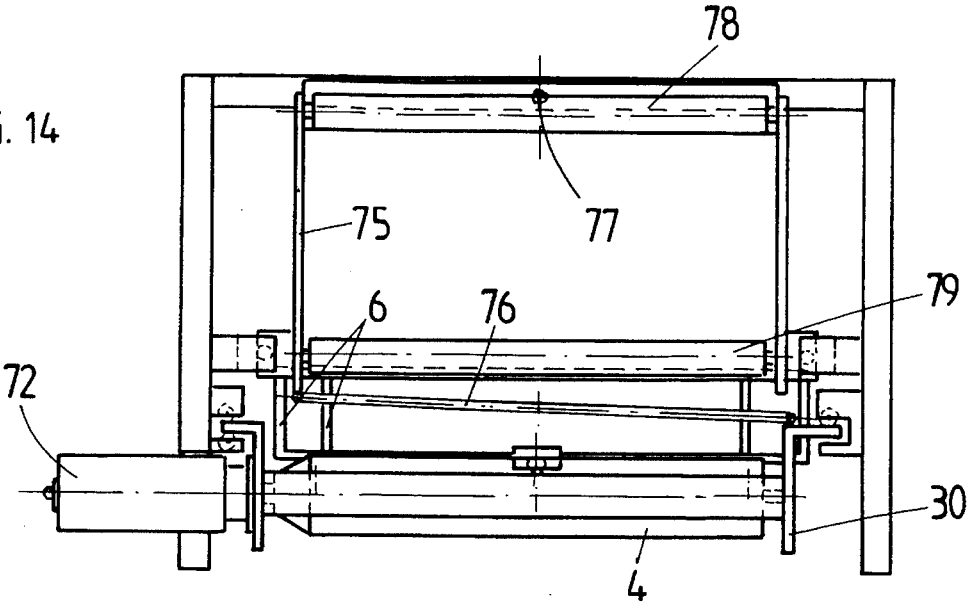
FIG. 14 shows a section along XIV—XIV according to FIG. 13.
Figure 13:
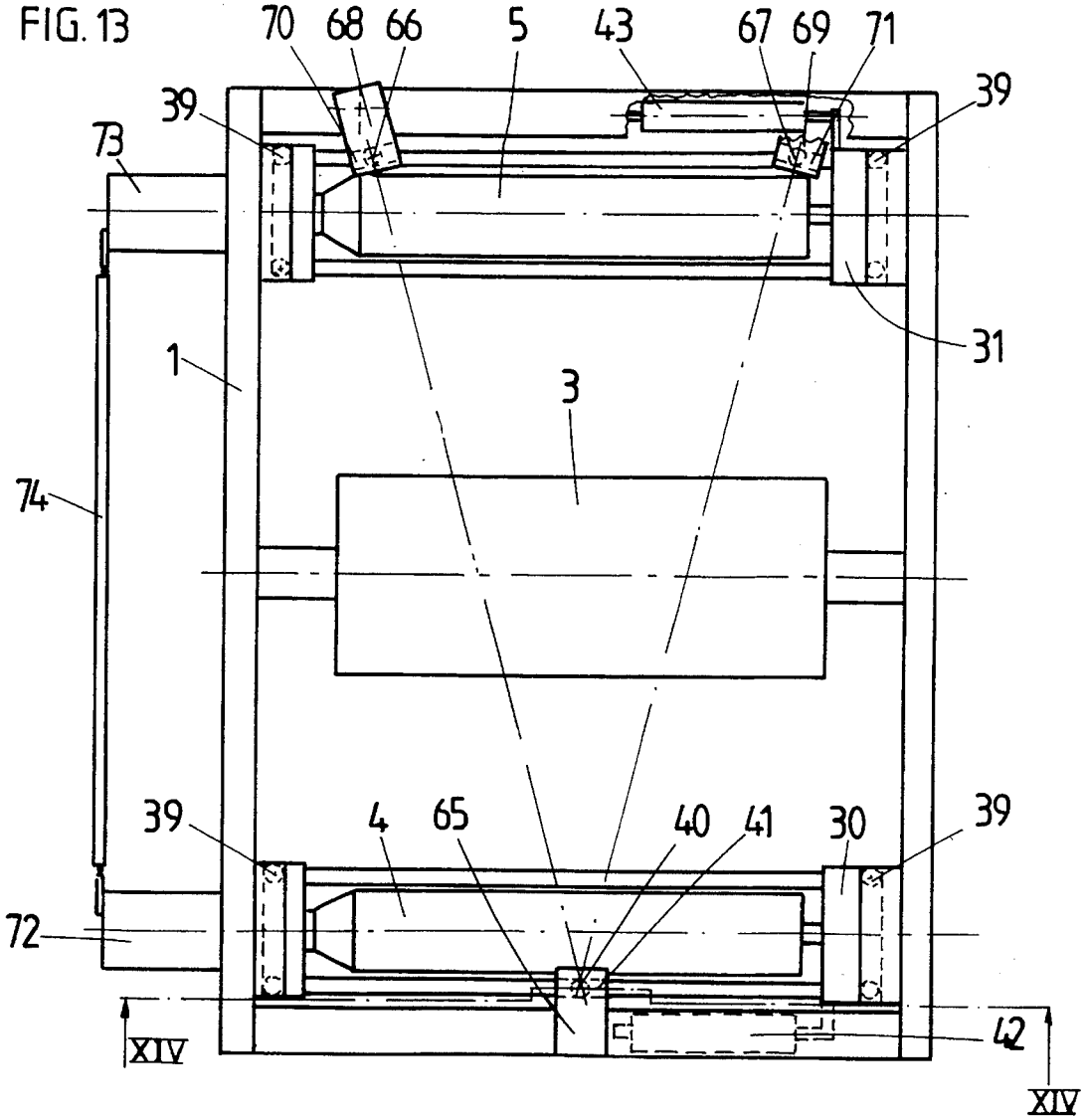
FIG. 13 shows a fourth embodiment of the invention, corresponding to the view according to FIG. 10.

FIGS. 13 and 14 show a further embodiment of a directing device, in which the drawing rollers 4 and 5 form the infeed and discharge rollers on both sides of the nip and, as in the example according to FIG. 12, are mounted in independent frame parts 30 and 31 which again, by means of ball-type guides 39, can be displaced in the plane running through the roller axes.

The frame part 30 with the drawing roller 4 is, as in the example according to FIGS. 11 and 12, guided in the framework 1 by means of a central cam roller 40 which can be adjusted in a groove 41, parallel to the axis of the cylinder 3, of a guide segment 65 fastened in the framework 1.

The other frame part 31 is guided in the machine framework 1 by two cam rollers 66 and 67, the two cam rollers being arranged as far as possible outside the center of the drawing roller 5, between paper-web edge and inner edge of the machine framework. Said cam rollers, of which the axes again lie perpendicularly with respect to the plane running through the roller axes, run in grooves 70 and 71 of guide segments 68 and 69, which can be individually adjusted in a sloping manner with respect to the axis of rotation of the drawing rollers such that, for the frame part 31 with the drawing roller 5, an imaginary point of rotation is produced which coincides with the point of rotation of the cam roller 40. In FIG. 13, this is illustrated by the two chain-dotted lines which extend from the cam rollers 66 and 67 and intersect at the point of rotation of the cam roller 40.

The two frame parts 30 and 31 are connected to one another by a push rod 74 which, outside the machine framework 1, connects the motors 72 and 73 which are flange-mounted fixedly on the frame parts 30 and 31. In the case of this embodiment, as in the example according to FIGS. 7 to 11, each drawing roller 4 and 5 requires only one actuating member 42 and 43 in each case. Owing to the arrangement of the guides in the grooves 41, 70 and 71, the drawing roller 4, guided by way of the groove 41, can be displaced parallel with respect to the cylinder 3. There then remains the degree of freedom of the rotation about the axis of the cam roller 40. This rotation is controlled by the abovementioned push rod 74. In the event of a displacement of the drawing roller 5 in the guide grooves 70 and 71, said drawing roller approximately describes an arc of a circle about the cam roller 40. By virtue of the push rod 74, the drawing roller 4 is likewise rotated about the cam roller 40 and is constantly retained at least approximately parallel with respect to the drawing roller 5.

Figure 15:
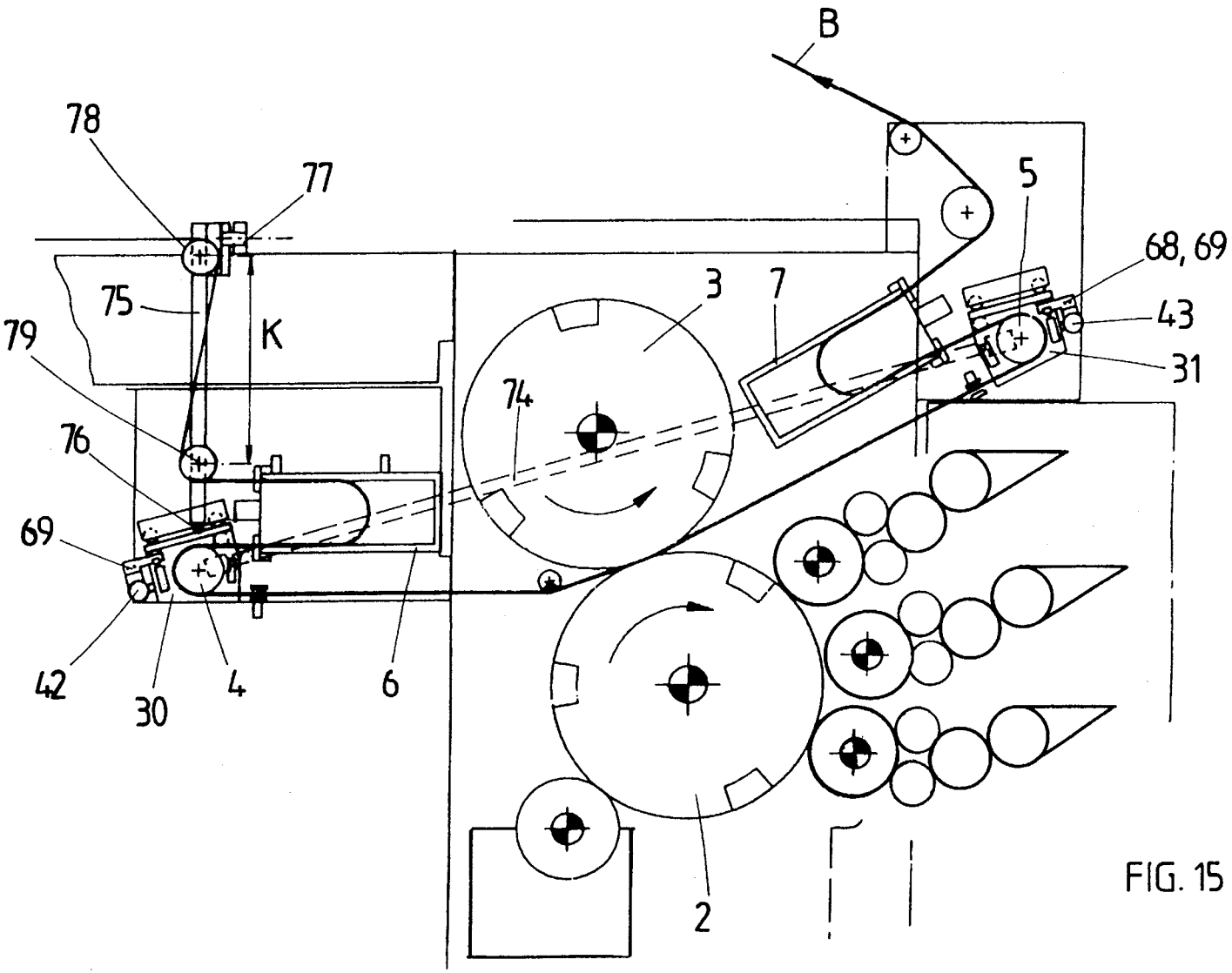
FIG. 15 shows a side view of the device according to FIG. 13 having a rotary frame as feeding device.

FIGS. 14 and 15 show, for this example, a further embodiment of the upstream feeding device in the form of a rotary frame 75 which has the infeed roller 78 and the discharge roller 79 and, in the center of its inlet side, is mounted in the framework 1 by means of the rotary spindle 77 and is connected to the frame part 30 of the drawing roller 4 by means of an articulated push rod 76. In this case, the paper store 6 is thus fixedly anchored in the machine framework i and is located within the transporting stretch of the paper web between the rotary frame 75, forming the feeding device, and the web-directing device, which is formed essentially by the two frame parts 30 and 31. This arrangement produces a greater correction length K (FIG. 15) than is possible using the web store 6 as feeding device in the example according to FIGS. 7 to 11.

The upstream rotary frame 75 corresponds essentially to the rotary frame 20 in the example according to the FIGS. 2 to 6, the infeed and discharge rollers 78, 79, corresponding to the infeed and discharge rollers 22 and 23, and the rotary spindle 77 corresponding to the rotary spindle In the case of conventional web-fed printing machines with a constant paper-web speed, the register device represented in FIGS. 2 to 6 may be provided with two rotary frames, while, in the case of web-fed printing machines with pilgrim-step-operation paper-web transportation, the two drawing rollers and the first paper-web store and/or the upstream rotary frame form the directing and feeding devices.

In all cases, the device according to the invention makes it possible for a paper web which, as a result of non-uniformity in the paper over the web width, is discharged obliquely out of the paper-web store and/or reaches the infeed roller of the directing device in an oblique position, or changes its direction in an oscillating manner, to be aligned again precisely with respect to the nip by suitable control and deflection of the infeed and discharge rollers, with the result that a precise side register and oblique register are maintained.

The drawing rollers may also be customary drawing rollers which interact with a press-on roller, that is to say part of a conventional drawing-roller group, and the paper-web stores may be of any type of construction.

I claim:

1. A web-fed printing machine having a framework and two cylinders which form a printing nip for a web; means for directing the web through the nip including a register device for aligning the web, said device including an infeed roller and a discharge roller which guide the web; means for controlling the position of said infeed roller and discharge roller comprising an actuating device; web-edge sensors for sensing the edge of a web; said register device being responsive to signals from said web-edge sensors; said infeed roller being positioned upstream of said nip and said discharge roller being positioned downstream of the nip; said web-edge sensors being positioned on both sides of the nip, means for displacing said infeed roller and discharge roller relative to said framework of the printing machine in a plane running through the axes of said rollers; said actuating device having actuating members for individually adjusting said rollers; means for mounting said rollers for individual displacement in the direction of their axes of rotation and for pivotable movement into an oblique position; a web-feeding device positioned upstream of said web-directing device; said web-feeding device, on its infeed side, being pivotally mounted about a spindle, said spindle being mounted in a stationary manner in said machine framework and positioned in a plane which is oriented perpendicularly with respect to the axis of said infeed roller and at least approximately intersects said infeed roller in the center thereof, and said web-directing device and said web-feeding device being connected to one another.

2. The web-fed printing machine as claimed in claim 1, wherein said infeed roller and said discharge roller are obliquely pivotable about a common imaginary axis which is defined by a line, running centrally through said nip connecting said axes of said two cylinders.

3. The web-fed printing machine as claimed in claim 2, wherein said infeed roller and said discharge roller of said web-directing device are mounted at two ends of a common frame, and said two ends include means for adjustment in a direction of said axes of said rollers by said actuating members, and wherein one of said frame ends includes means for pivoting about a pivot spindle perpendicularly to said plane running through said axes of said rollers, said pivot spindle being arranged centrally with respect to the roller, which is mounted at said one of said frame ends, said pivot spindle including means for displacing it freely and transversely with respect to a web-transporting direction.

4. The web-fed printing machine as claimed in claim 3, wherein the said pivot spindle is mounted at an infeed end of said frame.

5. The web-fed printing machine as claimed in claim 1, wherein said infeed roller and said discharge roller of said web-directing device are mounted in separate frame parts, and wherein each said separate frame part includes means for pivoting about a separate pivot spindle which is perpendicular to said plane, each said separate pivot spindle being arranged centrally with respect to one of said infeed roller and said discharge roller and includes means for displacing freely and transversely with respect to a web-transporting direction, and wherein two actuating members include means for adjusting each said frame part wherein a first of said actuating members effects displacement of said frame part in a direction of said axis of one of said infeed roller and said discharge roller and wherein a second of said actuating members effects pivoting about said pivot spindle (40, 60).

6. The web-fed printing machine as claimed in claim 3, wherein said pivot spindle comprises a cam roller guided in a groove of said machine framework, said groove running parallel to said axis of one of said infeed roller and said discharge roller.

7. The web-fed printing machine as claimed in claim 1, wherein said infeed roller and said discharge roller are mounted in first and second frame parts, respectively wherein said first frame part is connected to said second frame part by a lateral push rod, wherein said first frame part is guided, by means of a cam roller arranged centrally with respect to said infeed roller, through a guide segment parallel to the axis of one of said cylinders, wherein said second frame part is guided by two cam rollers installed on first and second sides of a center of said roller, in guide segments which are mounted adjustably on said machine framework and include means for individual sloping adjustment with respect to an axis of rotation of said infeed and discharge rollers whereby for said second frame part, the point of rotation of the cam roller of the first frame part forms an imaginary point of rotation, and wherein said first and second frame parts can be adjusted by one of said actuating members.

8. The web-fed printing machine as claimed in claim 1, comprising upstream of said nip, as seen in the transporting direction of the web, a first drawing roller and upstream of said first drawing roller, a first paper-web store, and downstream of said nip, as seen in the transporting direction of the web, a second drawing roller and downstream of said second drawing roller, a second paper-web store, wherein said first and second drawing rollers form said infeed and discharge rollers of the web-directing device, and wherein said first paper-web store comprises said web-feeding device, which can be pivoted about said spindle, and to which said first drawing roller is coupled.

9. The web-fed printing machine as claimed in claim 1, wherein the web-feeding device is formed by a first rotary frame with an infeed roller and a discharge roller, wherein the web-directing device is formed by a second rotary frame with also an infeed roller and a discharge roller, wherein said first rotary frame includes means for pivoting about said stationary spindle on an infeed side of said frame, wherein said second rotary frame is offset perpendicularly with respect to a plane of said first rotary frame, wherein a discharge side of said first rotary frame and an infeed side of said second rotary frame are located at least approximately vertically above other, said discharge side of said first rotary frame further being connected to said infeed side of said second rotary frame by a common spindle oriented centrally with respect to sides of said first and second rotary frames and further forms said pivot spindle, and wherein said infeed side and said discharge side of said second rotary frame includes means for traverse displacement with respect to the running direction of the paper web responsive to one of said actuating members.

10. The web-fed printing machine as claimed in claim 5, wherein said pivot spindle comprises a cam roller guided in a groove of said machine framework, said groove running parallel to said axis of one of said infeed roller and said discharge roller.

* * * * *